US010726754B2

(12) United States Patent
Wang et al.

(10) Patent No.: US 10,726,754 B2
(45) Date of Patent: Jul. 28, 2020

(54) DEFECT DETECTION CIRCUIT AND METHOD FOR LIGHT-EMITTING ELEMENT, DISPLAY DRIVING DEVICE, DISPLAY DEVICE AND DEFECT DETECTION METHOD THEREOF

(71) Applicants: BOE Technology Group Co., Ltd., Beijing (CN); Ordos Yuansheng Optoelectronics Co., Ltd., Inner Mongolia (CN)

(72) Inventors: Xiaowei Wang, Beijing (CN); Guoqing Zhang, Beijing (CN); Longfei Yang, Beijing (CN); Lei Wang, Beijing (CN); Ke Zhao, Beijing (CN); Weifeng Wang, Beijing (CN); Hongxia Yang, Beijing (CN); Meili Guo, Beijing (CN); Feiwen Tian, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 16/190,406

(22) Filed: Nov. 14, 2018

(65) Prior Publication Data

US 2019/0236992 A1 Aug. 1, 2019

(30) Foreign Application Priority Data

Jan. 26, 2018 (CN) ..... 2018 1 0075877

(51) Int. Cl.

| | |
|---|---|
| ***G09G 3/00*** | (2006.01) |
| ***G09G 3/3225*** | (2016.01) |
| ***G09G 3/3233*** | (2016.01) |

(52) U.S. Cl.
CPC ..... *G09G 3/006* (2013.01); *G09G 3/3225* (2013.01); *G09G 3/3233* (2013.01); (Continued)

(58) Field of Classification Search
None
See application file for complete search history.

(56) References Cited

U.S. PATENT DOCUMENTS

| | | | | |
|---|---|---|---|---|
| 2014/0111563 | A1* | 4/2014 | Hwang | G09G 3/003 345/691 |
| 2017/0270860 | A1* | 9/2017 | Wang | G09G 3/3233 |
| 2018/0158409 | A1* | 6/2018 | Byun | G09G 3/3208 |

* cited by examiner

*Primary Examiner* — Christopher J Kohlman
(74) *Attorney, Agent, or Firm* — Westman, Champlin & Koehler, P.A.

(57) ABSTRACT

A defect detection circuit and a defect detection method for a light-emitting element, a display driving device, a display device, and a defect detection method for the display device are provided. The defect detection circuit includes a power source signal adjustment sub-circuit, a data signal adjustment sub-circuit, a first initial signal adjustment sub-circuit, a second initial signal adjustment sub-circuit and a storage capacitor connected to a control end of a driving transistor. The storage capacitor is configured to control the driving transistor to be turned off under the effect of a power source signal, a data signal and an initial signal, to enable the second initial signal adjustment sub-circuit to apply the initial signal to a light-emitting sub-circuit, thereby to enable the light-emitting sub-circuit to emit light. The display driving device includes the defect detection circuit.

18 Claims, 1 Drawing Sheet

(52) U.S. Cl.
CPC ..... *G09G 2300/0861* (2013.01); *G09G 2310/0251* (2013.01); *G09G 2310/0262* (2013.01); *G09G 2330/12* (2013.01)

DEFECT DETECTION CIRCUIT AND METHOD FOR LIGHT-EMITTING ELEMENT, DISPLAY DRIVING DEVICE, DISPLAY DEVICE AND DEFECT DETECTION METHOD THEREOF

CROSS-REFERENCE TO RELATED APPLICATION

The present application claims a priority of the Chinese patent application No. 201810075877.5 filed on Jan. 26, 2018, which is incorporated herein by reference in its entirety.

TECHNICAL FIELD

The present disclosure relates to the field of display technology, in particular to a defect detection circuit and a defect detection method for a light-emitting element, a display driving device, a display device and a defect detection method for the display device.

BACKGROUND

In the related art, during the mass production of an active-matrix organic light-emitting diode (AMOLED) display device, a light-emitting element is packaged through a packaging process, so as to protect the light-emitting element. However, moisture may probably enter the light-emitting element. At this time, extrinsic degradation may occur at parts of regions of the light-emitting element, and thereby the luminous efficiency of the light-emitting element may be degraded.

SUMMARY

An object of the present disclosure is to provide a defect detection circuit and a defect detection method for a light-emitting element, a display driving device, a display device and a defect detection method for the display device.

In one aspect, the present disclosure provides in some embodiments a defect detection circuit for a light-emitting element, including a storage capacitor and a light-emitting sub-circuit. A first polar plate of the storage capacitor is connected to a power source signal adjustment sub-circuit and a data signal adjustment sub-circuit, and a second polar plate of the storage capacitor is connected to a first initial signal adjustment sub-circuit and a control end of a driving transistor. An input end of the driving transistor is connected to a first power source signal end, an output end of the driving transistor and a second initial signal adjustment sub-circuit are connected to the light-emitting sub-circuit, and the light-emitting sub-circuit is further connected to a second power source signal end. At a same moment, under the control of a resetting signal, the power source signal adjustment sub-circuit is configured to apply a power source signal to the first polar plate of the storage capacitor, and the first initial signal adjustment sub-circuit is configured to apply an initial signal to the second polar plate of the storage capacitor. At the same moment, under the control of a scanning signal, the data signal adjustment sub-circuit is configured to apply a data signal to the first polar plate of the storage capacitor, and the second initial signal adjustment sub-circuit is configured to apply the initial signal to the light-emitting sub-circuit. At the same moment, the storage capacitor is configured to enable the driving transistor to be turned off under the effect of the power source signal, the initial signal and the data signal, so as to enable the light-emitting sub-circuit to emit light under the effect of the initial signal.

In another aspect, the present disclosure provides in some embodiments a defect detection method for a light-emitting element for use in the above-mentioned defect detection circuit, including: at a same moment, under the control of a resetting signal, applying, by a power source signal adjustment sub-circuit, a power source signal to a first polar plate of a storage capacitor, and applying, by a first initial signal adjustment sub-circuit, an initial signal to a second polar plate of the storage capacitor; at the same moment, under the control of a scanning signal, applying, by a data signal adjustment sub-circuit, a data signal to the first polar plate of the storage capacitor, and applying, by a second initial signal adjustment sub-circuit, the initial signal to a light-emitting sub-circuit; at the same moment, enabling, by the storage capacitor, a driving transistor to be turned off under the effect of the power source signal, the initial signal and the data signal, so as to enable the light-emitting sub-circuit to emit light under the effect of the initial signal; and determining whether there is extrinsic degradation for the light-emitting element in the light-emitting sub-circuit in accordance with an intensity of a light beam emitted by the light-emitting sub-circuit.

In yet another aspect, the present disclosure provides in some embodiments a display driving device including a plurality of pixel compensation circuits. At least one of the pixel compensation circuits includes the above-mentioned defect detection circuit.

In still yet another aspect, the present disclosure provides in some embodiments a display device including the above-mentioned display driving device.

In still yet another aspect, the present disclosure provides in some embodiments a defect detection method for the above-mentioned display device, including: energizing each light-emitting sub-circuit through the defect detection circuit included in a pixel compensation circuit in the display device, and determining whether extrinsic degradation occurs for a light-emitting element in the light-emitting sub-circuit in accordance with an intensity of a light beam generated by the light-emitting sub-circuit.

BRIEF DESCRIPTION OF THE DRAWINGS

The following drawings are provided to facilitate the understanding of the present disclosure, and constitute a portion of the description. These drawings and the following embodiments are for illustrative purposes only, but shall not be construed as limiting the present disclosure. In these drawings.

REFERENCE SIGN LIST

Figure 1:
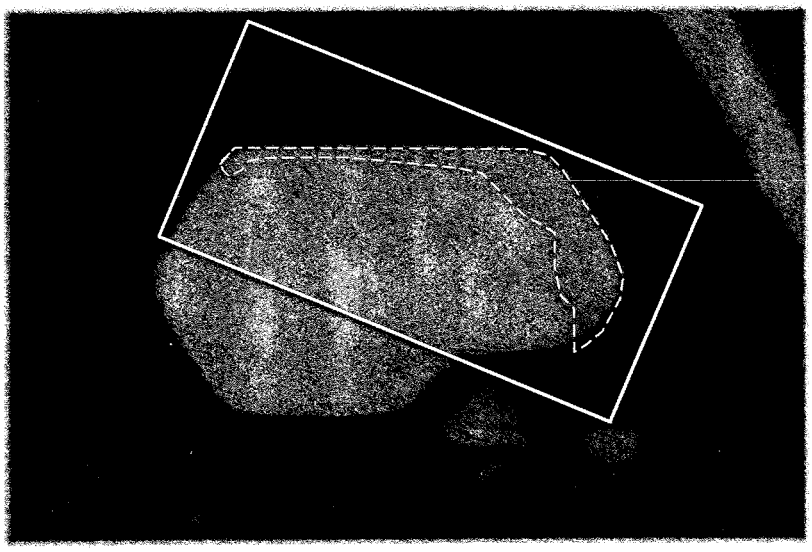
FIG. 1 is a micrograph of a light-emitting element where corrosion occurs for a cathode in related art.

100 power source signal adjustment sub-circuit
200 data signal adjustment sub-circuit
300 first initial signal adjustment sub-circuit
400 second initial signal adjustment sub-circuit
500 light-emitting sub-circuit
600 reference signal adjustment sub-circuit
T1 first transistor
T2 second transistor T3 third transistor
T4 fourth transistor
T5 fifth transistor
T6 sixth transistor
Cs storage capacitor
Cp protection capacitor
L light-emitting element
G scanning signal end
DATA data signal end
DTFT driving transistor
K switch
VDD first power source signal end
VSS second power source signal end
Vref reference signal end
Vinit initial signal end
Re resetting signal end
EM light-emitting signal end

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Such words as "include" or "including" intends to indicate that an element or object before the word contains an element or object or equivalents thereof listed after the word, without excluding any other element or object. Such words as "connect/connected to" or "couple/coupled to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Usually, degradation not caused by basic properties of an element, e.g., a structure and a material, is called as extrinsic degradation. When a light-emitting element of an AMOLED display device where the extrinsic degradation occurs is viewed through a microscope, corrosion occurs for a cathode of the light-emitting element, as indicated by a dashed line in FIG. 1, and this phenomenon is called as cathode contraction of the light-emitting element. An extrinsic degradation level of the light-emitting element is relatively tiny within a short time period, but with the elapse of time, the extrinsic degradation level of the light-emitting element may become more and more serious. Hence, at the very beginning of the extrinsic degradation, it is very difficult to detect the light-emitting element of the AMOLED display device where the extrinsic degradation occurs.

Figure 2:
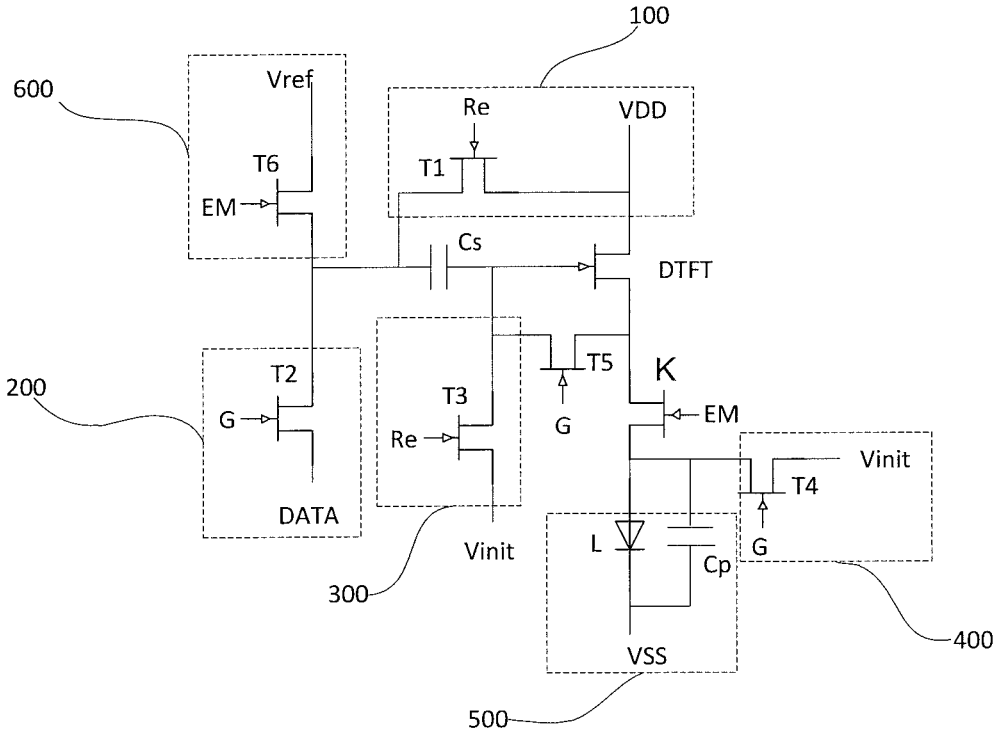
FIG. 2 is a circuit diagram of a defect detection circuit for a light-emitting element according to one embodiment of the present disclosure.

Referring to FIG. 2, the present disclosure provides in some embodiments a defect detection circuit for a light-emitting element, which includes a storage capacitor Cs and a light-emitting sub-circuit 500. A first polar plate of the storage capacitor Cs is connected to a power source signal adjustment sub-circuit 100 and a data signal adjustment sub-circuit 200, and a second polar plate of the storage capacitor Cs is connected to a first initial signal adjustment sub-circuit 300 and a control end of a driving transistor DTFT. An input end of the driving transistor DTFT is connected to a first power source signal end VDD, an output end of the driving transistor DTFT and a second initial signal adjustment sub-circuit 400 are connected to the light-emitting sub-circuit 500, and the light-emitting sub-circuit 500 is further connected to a second power source signal end VSS.

During the implementation, at a same moment, under the control of a resetting signal, the power source signal adjustment sub-circuit 100 is configured to apply a power source signal to the first polar plate of the storage capacitor Cs, and the first initial signal adjustment sub-circuit 300 is configured to apply an initial signal to the second polar plate of the storage capacitor Cs. Under the control of a scanning signal, the data signal adjustment sub-circuit 200 is configured to apply a data signal to the first polar plate of the storage capacitor Cs, and the second initial signal adjustment sub-circuit 400 is configured to apply the initial signal to the light-emitting sub-circuit 500. The storage capacitor Cs is configured to enable the driving transistor DTFT to be turned off under the effect of the power source signal, the initial signal and the data signal, so as to enable the light-emitting sub-circuit 500 to emit light under the effect of the initial signal. In this way, it is able to determine whether extrinsic degradation occurs for the light-emitting element L in the light-emitting sub-circuit 500 in accordance with an intensity of a light beam emitted by the light-emitting sub-circuit 500.

It should be appreciated that, various light-emitting elements may have different standard light intensities when currents of different sizes are applied. When the light intensity of the light beam emitted by the light-emitting sub-circuit 500 is smaller than the standard light intensity, it means that the degradation occurs for the light-emitting element in the light-emitting sub-circuit 500.

Based on the structure of the defect detection circuit and an operation procedure thereof, in the defect detection circuit, the first polar plate of the storage capacitor Cs is connected to the power source signal adjustment sub-circuit 100 and the data signal adjustment sub-circuit 200, and the second polar plate of the storage capacitor Cs is connected to the first initial signal adjustment sub-circuit 300 and the control end of the driving transistor DTFT. The input end of the driving transistor DTFT is connected to the first power source signal end VDD, and the output end of the driving transistor DTFT and the second initial signal adjustment sub-circuit 400 are connected to the light-emitting sub-circuit 500. At the same moment, under the control of the resetting signal, the power source signal is applied by the power source signal adjustment sub-circuit 100 to the first polar plate of the storage capacitor Cs, and the initial signal is applied by the first initial signal adjustment sub-circuit 300 to the second polar plate of the storage capacitor Cs. Under the control of the scanning signal, the data signal is applied by the data signal adjustment sub-circuit 200 to the first polar plate of the storage capacitor Cs, and the initial signal is applied by the second initial signal adjustment sub-circuit 400 to the light-emitting sub-circuit 500. As a result, the storage capacitor Cs controls the driving transistor DTFT to be turned off under the effect of the power source signal, the initial signal and the data signal, so that the light-emitting sub-circuit 500 is capable of emitting the light under the effect of the initial signal. Hence, during the defect detection of the light-emitting element, it is able for the defect detection circuit to enable the light-emitting element L in the light-emitting sub-circuit 500 to emit light without any resetting stage and scanning stage. The light is generated by the light-emitting sub-circuit 500 directly under the effect of the initial signal from the second initial signal adjustment sub-circuit 400, so as to increase the injection efficiency of electrons for the light-emitting sub-circuit 500. When the defect detection circuit is applied to an OLED display device, it is able to increase the injection efficiency of electrons for the light-emitting sub-circuit 500, and easily detect any slight corrosion for a cathode of the light-emitting element L in the light-emitting sub-circuit 500 through a light-on test, thereby to increase a detection rate of the extrinsic degradation for the light-emitting element L.

It should be appreciated that, in the related art, at a light-emitting stage subsequent to the resetting stage and the scanning stage, the light-emitting sub-circuit 500 is controlled by the driving transistor DTDT to emit light under the effect of the power source signal. However, in the embodiments of the present disclosure, at the same moment, the driving transistor DTFT may be turned off under the effect of the power source signal, the initial signal and the data signal, and the light-emitting sub-circuit 500 may emit light under the effect of the initial signal. In this way, it is able to increase the injection efficiency of electrons for the light-emitting element L in the light-emitting sub-circuit 500, and detect any slight corrosion for the cathode of the light-emitting element L in the light-emitting sub-circuit 500 by detecting a decrease in the intensity of the light beam emitted by the light-emitting element L through a light-on test, thereby to detect the light-emitting sub-circuit 500 where the extrinsic degradation occurs.

It should be appreciated that, at the same moment, a voltage of the initial signal is greater than or equal to a minimum operating voltage of the light-emitting sub-circuit 500, so as to enable the light-emitting sub-circuit 500 to emit light under the effect of the initial signal.

In a possible embodiment of the present disclosure, when the voltage of the initial signal is equal to the minimum operating voltage of the light-emitting sub-circuit 500, the light-emitting sub-circuit 500 may emit light at a minimum current under the effect of the initial signal. At this time, the light beam emitted by the light-emitting sub-circuit 500 has the lowest intensity, so as to prevent the light-emitting element L in the light-emitting sub-circuit 500 from being damaged. Through the defect detection circuit in the embodiments of the present disclosure, it is able to improve the detection rate of the extrinsic degradation for the light-emitting element L in the case that the light beam emitted by the light-emitting sub-circuit 500 has a relatively low intensity.

Theoretically, an off-state voltage of the driving transistor DTFT depends on a type of the driving transistor DTFT. However, because the light-emitting sub-circuit 500 emits light under the effect of the initial signal, the voltage of the initial signal needs to be greater than 0. When the initial signal is applied by the first initial signal adjustment sub-circuit 300 to the second polar plate of the storage capacitor Cs, the second polar plate of the storage capacitor Cs may be at a relatively high potential. The second polar plate of the storage capacitor Cs is connected to both the first initial signal adjustment sub-circuit 300 and the control end of the driving transistor DTFT, so the driving transistor DTFT needs to be turned off at the high potential. At this time, the driving transistor DTFT may be an NPN transistor or a P-channel Metal-Oxide-Semiconductor Field-Effect Transistor (PMOSFET). When a potential at the first polar plate of the storage capacitor Cs is different from the potential at the second polar plate of the storage capacitor Cs, a voltage jump may occur across the two ends of the storage capacitor Cs. A voltage applied to the control end of driving transistor DTFT may be compensated by the first polar plate of the storage capacitor Cs, so as to control the driving transistor DTFT to be turned off.

In the defect detection circuit in the embodiments of the present disclosure, in the case that the driving transistor DTFT is turned off, the light emission of the light-emitting element L may not be adversely affected by the power source signal from the power source signal adjustment sub-circuit 100 and the data signal from the data signal adjustment sub-circuit 200. Hence, a voltage of each of the power source signal and the data signal is 0, so as to reduce the detection cost.

A light-emitting signal and a reference signal are further introduced into some compensation circuits with a complex structure. Based on this, as shown in FIG. 2, the defect detection circuit may further include a reference signal adjustment sub-circuit 600 connected to the first polar plate of the storage capacitor Cs, and a switch K through which the first initial signal adjustment sub-circuit 300 is connected to the light-emitting sub-circuit 500.

During the implementation, at the same moment, the reference signal adjustment sub-circuit 600 is configured to apply a reference signal to the first polar plate of the storage capacitor Cs under the control of a light-emitting signal. The switch K is configured to be turned off under the effect of the light-emitting signal, so as to, when the light-emitting sub-circuit 500 emits light under the effect of the initial signal from the second initial signal adjustment sub-circuit 400, prevent the transmission of the initial signal from the first initial signal adjustment sub-circuit 300 to the light-emitting sub-circuit 500 through the switch K.

It should be appreciated that, as shown in FIG. 2, a control end of the switch K is connected to a light-emitting signal end EM, an input end of the switch K is further connected to the output end of the driving transistor DTFT, and an output end of the switch K is connected to the light-emitting sub-circuit 500.

It should be appreciated that, as shown in FIG. 2, the light-emitting sub-circuit 500 includes the light-emitting element L (e.g., a light-emitting diode) L and a protection capacitor Cp. The output end of the switch K is connected to an anode of the light-emitting element L and a first polar plate of the protection capacitor Cp, the second initial signal adjustment sub-circuit 400 is connected to the anode of the light-emitting element L and the first polar plate of the protection capacitor Cp, and a cathode of the light-emitting element L and a second polar plate of the protection capacitor Cp are connected to the second power source signal end VSS. When the light-emitting element L emits light under the effect of the initial signal, the protection capacitor Cp may be charged by the initial signal. As a result, in the case that there is no initial signal, the protection capacitor Cp may be discharged toward the light-emitting element L, so as to enable the light-emitting element L to be turned off gradually, thereby to effectively protect the light-emitting element L.

An operating principle of the defect detection circuit will be described hereinafter by taking the defect defection circuit in FIG. 2 as an example.

The defect detection circuit for the light-emitting element includes the storage capacitor Cs, the light-emitting sub-circuit 500, the driving transistor DTFT, the power source signal adjustment sub-circuit 100, the data signal adjustment sub-circuit 200, the first initial signal adjustment sub-circuit 300, the second initial signal adjustment sub-circuit 400 and the reference signal adjustment sub-circuit 600.

The power source signal adjustment sub-circuit 100 includes a first transistor T1, a control end of the first transistor T1 is connected to a resetting signal end Re, an input end of the first transistor T1 is connected to first power source signal end VDD, and an output end of the first transistor T1 is connected to the first polar plate of the storage capacitor Cs.

The data signal adjustment sub-circuit 200 includes a second transistor T2, a control end of the second transistor T2 is connected to a scanning signal end G, an input end of the second transistor T2 is connected to a data signal end DATA, and an output end of the second transistor T2 is connected to the first polar plate of the storage capacitor Cs.

The first initial signal adjustment sub-circuit 300 includes a third transistor T3, a control end of the third transistor T3 is connected to the resetting signal end Re, an input end of the third transistor T3 is connected to an initial signal end Vinit, and an output end of the third transistor T3 is connected to the second polar plate of the storage capacitor Cs. The second polar plate of the storage capacitor Cs is connected to the control end of the driving transistor DTFT, and the input end of the driving transistor DTFT is connected to the first power source signal end VDD.

The second initial signal adjustment sub-circuit 400 includes a fourth transistor T4, a control end of the fourth transistor T4 is connected to the scanning signal end G, an input end of the fourth transistor T4 is connected to the initial signal end Vinit, and an output end of the fourth transistor T4 is connected to the light-emitting sub-circuit 500.

The defect detection circuit may further include a fifth transistor T5, a control end of the fifth transistor T5 is connected to the scanning signal end G, an input end of the fifth transistor T5 is connected to the second polar plate of the storage capacitor Cs and the output end of the first initial signal adjustment sub-circuit 300 (i.e., the output end of the third transistor T3), and an output end of the fifth transistor T5 is connected to the output end of the driving transistor DTFT and the input end of the switch K. The control end of the switch K is connected to the light-emitting signal end EM, the input end of the switch K is further connected to the output end of the driving transistor DTFT, and the output end of the switch K is connected to the light-emitting sub-circuit 500. At the same moment, the fifth transistor T5 is configured to be turned on under the control of the scanning signal.

The reference signal adjustment sub-circuit 600 includes a sixth transistor T6, a control end of the sixth transistor T6 is connected to the light-emitting signal end EM, an input end of the sixth transistor T6 is connected to a reference signal end Vref, and an output end of the sixth transistor T6 is connected to the first polar plate of the storage capacitor Cs.

It should be appreciated that, an on-state voltage or an off-stage voltage of each transistor or the switch K depends on a type of the transistor or the switch K.

For example, the first transistor T1, the second transistor T2, the third transistor T3, the fourth transistor T4, the fifth transistor T5, the sixth transistor T6 and the switch K may each be an NPN transistor or a PMOSFET, and the first transistor T1, the second transistor T2, the third transistor T3, the fourth transistor T4, the fifth transistor T5, the sixth transistor T6 and the switch K may each be turned on at a low level, and turned off at a high level.

TABLE 1 voltages of signals for the defect detection circuit (unit: V)

| Scanning signal | Data signal | Initial signal | Resetting signal | Light-emitting signal | Reference signal | Power source signal | negative pole signal |
|---|---|---|---|---|---|---|---|
| 5/−6 | 0 | 4.6 | 0 | 6 | 0 | 0 | −4.4 |

Based on values of the signals in Table 1, at the same moment, the resetting signal end Re may output the low-level resetting signal of 0V, so as to turn on the first transistor T1 and the third transistor T3, thereby to enable the first transistor T1 to apply the low-level power source signal of 0V to the first polar plate of the storage capacitor Cs and enable the third transistor T3 to apply the high-level initial signal of 4.6V to the second polar plate of the storage capacitor Cs. The scanning signal end G may output the low-level scanning signal of −6V, so as to turn on the second transistor T2 and the fifth transistor T5, thereby to enable the second transistor T2 to apply the low-level data signal of 0V to the first polar plate of the storage capacitor Cs. At this time, although the fifth transistor T5 may apply the high-level initial signal of 4.6V from the third transistor T3 to the switch K, the high-level scanning signal of 6V is applied by the light-emitting signal end EM, so the sixth transistor T6 and the switch K may be turned off, and the sixth transistor T6 may not apply the low-level reference signal of 0V to the first polar plate of the storage capacitor Cs. At the same time, the high-level initial signal of 4.6V from the fifth transistor T5 may not be applied to the light-emitting sub-circuit 500 due to the switch K. Hence, a potential at the first polar plate of the storage capacitor Cs is 0V, and a potential at the second polar plate of the storage capacitor Cs is 4.6V. At this time, there is a voltage jump across the two ends of the storage capacitor Cs, so as to control the driving transistor DTFT to be turned off at a high level, thereby to prevent the light-emitting sub-circuit 500 from being affected by the low-level power source signal of 0V through the driving transistor DTFT and the switch K.

When the scanning signal end G outputs the low-level scanning signal of −6V, the fourth transistor T4 may also be turned on, so as to apply the high-level initial signal of 4.6V to the light-emitting sub-circuit 500. At this time, the negative pole signal of −4.4V may be applied by the second power source signal end VSS, so as to drive the light-emitting sub-circuit 500 to emit light.

To be specific, the sixth transistor T6 is in an off state, and the power source signal has a voltage of 0V, so even when the first transistor T1 is in an on state, no voltage or a low level may be applied to the light-emitting sub-circuit 500. At this time, the first transistor T1 has no effect on the defect detection on the light-emitting element.

The data signal has a voltage of 0V, so even when the second transistor T2 is in the on state, the second transistor T2 has no effect on the defect detection on the light-emitting element.

The driving transistor DTFT and the switch K are each in the off state, so the third transistor T3 and the fifth transistor T5 have no effect on the defect detection on the light-emitting element.

The light-emitting sub-circuit 500 needs to emit light under the effect of the initial signal, so it is necessary to ensure the fourth transistor T4 to be in the on state, so as to apply the initial signal to the light-emitting sub-circuit 500 through the fourth transistor T4, thereby to enable the light-emitting sub-circuit 500 to emit light. Hence, the fourth transistor T4 plays a very important role in the defect detection on the light-emitting element.

Based on the above analysis, in the defect detection circuit, it is able for the initial signal to drive the light-emitting sub-circuit 500 to emit light merely through the fourth transistor T4, without any resetting stage or scanning stage. As a result, it is able to reduce the quantity of transistors through which the signal for driving the light-emitting sub-circuit 500 passes, and reduce the adverse impact on the intensity of the light beam emitted by the light-emitting element by the insufficient manufacture accuracy of the transistor, thereby to improve the defect detection rate of the light-emitting element.

It should be appreciated that, during the operation of the defect detection circuit in FIG. 1, it is merely necessary to ensure that the driving transistor DTFT and the switch K are turned off and the fourth transistor T4 is turned on, regardless of whether the other transistors are turned off, the defect detection circuit may function properly to detect the defect in the light-emitting element. In addition, the light-emitting sub-circuit 500 may emit light under the effect of the initial signal through the fourth transistor T4 when the fourth transistor T4 is turned on under the effect of the scanning signal, and the normal operation of the defect detection circuit may not be adversely affected by the voltages of the other signals. Hence, when the above conditions are met, it is able to reduce the detection cost.

It should be further appreciated that, the data signal, the scanning signal, the resetting signal, the initial signal, the reference signal and the light-emitting signal may be applied to the defect detection circuit, so the defect detection circuit may serve as a pixel compensation circuit applied to a display device. When an image is displayed by the display device, the data signal, the scanning signal, the resetting signal, the initial signal, the reference signal and the light-emitting signal in the defect detection circuit need to vary like those in a pixel compensation circuit in the related art, so as to function as the pixel compensation circuit to drive the light-emitting sub-circuit 500 to emit light through the resetting stage, the scanning stage and the light-emitting stage.

The present disclosure further provides in some embodiments a defect detection method for use in the above-mentioned defect detection circuit, which includes: at a same moment, under the control of the resetting signal, applying, by the power source signal adjustment sub-circuit 100, the power source signal to the first polar plate of the storage capacitor Cs, and applying, by the first initial signal adjustment sub-circuit 300, the initial signal to the second polar plate of the storage capacitor Cs; under the control of the scanning signal, applying, by the data signal adjustment sub-circuit 200, the data signal to the first polar plate of the storage capacitor Cs, and applying, by the second initial signal adjustment sub-circuit 400, the initial signal to the light-emitting sub-circuit 500; enabling, by the storage capacitor Cs, the driving transistor DTFT to be turned off under the effect of the power source signal, the initial signal and the data signal, so as to enable the light-emitting sub-circuit 500 to emit light under the effect of the initial signal; and determining whether there is extrinsic degradation for the light-emitting element in the light-emitting sub-circuit 500 in accordance with an intensity of a light beam emitted by the light-emitting sub-circuit 500.

The beneficial effects of the defect detection method may refer to those of the defect detection circuit mentioned above, and thus will not be particularly defined herein.

In addition, at the same moment, the power source signal has a voltage of 0V, the data signal has a voltage of 0V, and a voltage of the initial signal is greater than or equal to a minimum operating voltage of the light-emitting sub-circuit 500.

The present disclosure further provides in some embodiments a display driving device including a plurality of pixel compensation circuits, and at least one of the pixel compensation circuits includes the above-mentioned defect detection circuit.

The beneficial effects of the display driving device may refer to those of the defect detection circuit mentioned above, and thus will not be particularly defined herein.

The present disclosure further provides in some embodiments a display device including the above-mentioned display driving device.

The beneficial effects of the display device may refer to those of the defect detection circuit mentioned above, and thus will not be particularly defined herein. The display device may be any product or member having a display function, e.g., mobile phone, flat-panel computer, television, display, laptop computer, digital photo frame or navigator.

As shown in FIG. 2, the prevent disclosure further provides in some embodiments a defect detection method for use in the above-mentioned display device, including energizing each light-emitting sub-circuit 500 through the defect detection circuit included in a pixel compensation circuit in the display device, and determining whether extrinsic degradation occurs for a light-emitting element in the light-emitting sub-circuit 500 in accordance with an intensity of a light beam generated by the light-emitting sub-circuit 500.

The beneficial effects of the defect detection method for use in the display device may refer to those of the defect detection circuit mentioned above, and thus will not be particularly defined herein.

To be specific, when each pixel compensation circuit in the display driving device of the display device includes the defect detection circuit, the light-emitting elements may be energized progressively in a row by row manner during the defect detection. After all the light-emitting elements have been energized, when there is a region with a relatively low brightness value on a display panel of the display device, it means that there is the extrinsic degradation for the cathode of the light-emitting element at the region.

For example, based on the types of the transistors mentioned hereinabove and the voltages of the signals in Table 1, when a current-row scanning signal end outputs the low-level scanning signal of −6V, it means that a current-row light-emitting element is being energized by the corresponding defect detection circuit. When the low-level scanning signal of −6V outputted by the current-row scanning signal end is changed to the high-level scanning signal of 5V, it means that the current-row light-emitting element has been energized by the corresponding defect detection circuit.

The above features, structures, materials or characteristics may be combined in any embodiment or embodiments in an appropriate manner.

The above embodiments are for illustrative purposes only, but the present disclosure is not limited thereto. A person skilled in the art may make further modifications and improvements without departing from the spirit of the present disclosure, and these modifications and improvements shall also fall within the scope of the present disclosure.

What is claimed is:

1. A defect detection circuit for a light-emitting element, comprising a storage capacitor and a light-emitting sub-circuit, wherein a first polar plate of the storage capacitor is connected to a power source signal adjustment sub-circuit and a data signal adjustment sub-circuit, a second polar plate of the storage capacitor is connected to a first initial signal adjustment sub-circuit and a control end of a driving transistor, an input end of the driving transistor is connected to a first power source signal end, an output end of the driving transistor and a second initial signal adjustment sub-circuit are connected to the light-emitting sub-circuit, and the light-emitting sub-circuit is further connected to a second power source signal end, wherein at a same moment, under the control of a resetting signal, the power source signal adjustment sub-circuit is configured to apply a power source signal to the first polar plate of the storage capacitor, and the first initial signal adjustment sub-circuit is configured to apply an initial signal to the second polar plate of the storage capacitor;

at the same moment, under the control of a scanning signal, the data signal adjustment sub-circuit is configured to apply a data signal to the first polar plate of the storage capacitor, and the second initial signal adjustment sub-circuit is configured to apply the initial signal to the light-emitting sub-circuit; and at the same moment, the storage capacitor is configured to enable the driving transistor to be turned off under the effect of the power source signal, the initial signal and the data signal, to enable the light-emitting sub-circuit to emit light under the effect of the initial signal, wherein the second initial signal adjustment sub-circuit comprises a fourth transistor, a control end of the fourth transistor is connected to a scanning signal end, an input end of the fourth transistor is directly connected to an initial signal end, and an output end of the fourth transistor is connected to the light-emitting sub-circuit, at the same moment, under the control of a resetting signal, applying, by the power source signal adjustment sub-circuit, the power source signal to the first polar plate of the storage capacitor, and applying, by the first initial signal adjustment sub-circuit, the initial signal to the second polar plate of the storage capacitor;

at the same moment, under the control of the scanning signal, applying, by the data signal adjustment sub-circuit, the data signal to the first polar plate of the storage capacitor, and applying, by the second initial signal adjustment sub-circuit, the initial signal to the light-emitting sub-circuit;

at the same moment, enabling, by the storage capacitor, the driving transistor to be turned off under the effect of the power source signal, the initial signal and the data signal, to enable the light-emitting sub-circuit to emit light under the effect of the initial signal; and determining whether there is degradation for the light-emitting element in the light-emitting sub-circuit in accordance with an intensity of a light beam emitted by the light-emitting sub-circuit.

2. The defect detection circuit according to claim 1, wherein at the same moment, the power source signal has a voltage of 0V, the data signal has a voltage of 0V, and a voltage of the initial signal is greater than or equal to a minimum operating voltage of the light-emitting sub-circuit.

3. The defect detection circuit according to claim 1, wherein the power source signal adjustment sub-circuit comprises a first transistor, a control end of the first transistor is connected to a resetting signal end, an input end of the first transistor is connected to a first power source signal end, and an output end of the first transistor is connected to the first polar plate of the storage capacitor; and the data signal adjustment sub-circuit comprises a second transistor, a control end of the second transistor is connected to a scanning signal end, an input end of the second transistor is connected to a data signal end, and an output end of the second transistor is connected to the first polar plate of the storage capacitor.

4. The defect detection circuit according to claim 1, wherein the first initial signal adjustment sub-circuit comprises a third transistor, a control end of the third transistor is connected to a resetting signal end, an input end of the third transistor is connected to an initial signal end, and an output end of the third transistor is connected to the second polar plate of the storage capacitor.

5. The defect detection circuit according to claim 1, wherein the first polar plate of the storage capacitor is further connected to a reference signal adjustment sub-circuit, and the first initial signal adjustment sub-circuit is connected to the light-emitting sub-circuit through a switch; and at the same moment, the reference signal adjustment sub-circuit is configured to apply a reference signal to the first polar plate of the storage capacitor under the control of a light-emitting signal, and the switch is configured to be turned off under the effect of the light-emitting signal.

6. The defect detection circuit according to claim 5, wherein a control end of the switch is connected to a light-emitting signal end, an input end of the switch is connected to the output end of the driving transistor, and an output end of the switch is connected to the light-emitting sub-circuit.

7. The defect detection circuit according to claim 5, further comprising a fifth transistor, a control end of the fifth transistor is connected to a scanning signal end, an input end of the fifth transistor is connected to the second polar plate of the storage capacitor and an output end of the first initial signal adjustment sub-circuit, and an output end of the fifth transistor is connected to the output end of the driving transistor and the input end of the switch, wherein at the same moment, the fifth transistor is configured to be turned on under the effect of the scanning signal.

8. The defect detection circuit according to claim 5, wherein the reference signal adjustment sub-circuit comprises a sixth transistor, a control end of the sixth transistor is connected to the light-emitting signal end, an input end of the sixth transistor is connected to a reference signal end, and an output end of the sixth transistor his connected to the first polar plate of the storage capacitor.

9. The defect detection circuit according to claim 5, wherein the light-emitting sub-circuit comprises the light-emitting element and a protection capacitor, the output end of the switch is connected to an anode of the light-emitting element and a first polar plate of the protection capacitor, the second initial signal adjustment sub-circuit is connected to the anode of the light-emitting element and the first polar plate of the protection capacitor, and a cathode of the light-emitting element and a second polar plate of the protection capacitor are connected to the second power source signal end.

10. The defect detection method according to claim 1, wherein at the same moment, the power source signal has a voltage of OV, the data signal has a voltage of OV, and a voltage of the initial signal is greater than or equal to a minimum operating voltage of the light-emitting sub-circuit.

11. The defect detection method according to claim 1, wherein the determining whether there is the degradation for the light-emitting element in the light-emitting sub-circuit in accordance with the intensity of the light beam emitted by the light-emitting sub-circuit comprises: determining whether there is extrinsic degradation for the light-emitting element in the light-emitting sub-circuit in accordance with the intensity of the light beam emitted by the light-emitting sub-circuit.

12. A display driving device, comprising a plurality of pixel compensation circuits, wherein at least one of the pixel compensation circuits comprises the defect detection circuit according to claim 1.

13. The display driving device according to claim 12, wherein at the same moment, the power source signal has a voltage of 0V, the data signal has a voltage of 0V, and a voltage of the initial signal is greater than or equal to a minimum operating voltage of the light-emitting sub-circuit.

14. The display driving device according to claim 12, wherein the power source signal adjustment sub-circuit comprises a first transistor, a control end of the first transistor is connected to a resetting signal end, an input end of the first transistor is connected to a first power source signal end, and an output end of the first transistor is connected to the first polar plate of the storage capacitor; and the data signal adjustment sub-circuit comprises a second transistor, a control end of the second transistor is connected to a scanning signal end, an input end of the second transistor is connected to a data signal end, and an output end of the second transistor is connected to the first polar plate of the storage capacitor.

15. The display driving device according to claim 12, wherein the first initial signal adjustment sub-circuit comprises a third transistor, a control end of the third transistor is connected to a resetting signal end, an input end of the third transistor is connected to an initial signal end, and an output end of the third transistor is connected to the second polar plate of the storage capacitor.

16. A display device, comprising the display driving device according to claim 12.

17. A defect detection method for use in the display device according to claim 16, comprising:

energizing each light-emitting sub-circuit through the defect detection circuit included in a pixel compensation circuit in the display device, and determining whether there is degradation for a light-emitting element in the light-emitting sub-circuit in accordance with an intensity of a light beam generated by the light-emitting sub-circuit.

18. The defect detection method according to claim 17, wherein the determining whether there is degradation for the light-emitting element in the light-emitting sub-circuit in accordance with the intensity of the light beam generated by the light-emitting sub-circuit comprises:

determining whether there is extrinsic degradation for the light-emitting element in the light-emitting sub-circuit in accordance with the intensity of the light beam generated by the light-emitting sub-circuit.

* * * * *